US005504557A

United States Patent [19]

Morita

[11] Patent Number: 5,504,557

[45] Date of Patent: Apr. 2, 1996

[54] ELECTROPHOTOGRAPHIC-PROCESS CONTROL APPARATUS HAVING IMPROVED OUTPUT-IMAGE-DENSITY CONTROL FUNCTION

[75] Inventor: Tetsuya Morita, Yokohama, Japan

[73] Assignee: Ricoh Co., Ltd., Tokyo, Japan

[21] Appl. No.: 134,312

[22] Filed: Oct. 8, 1993

[30] Foreign Application Priority Data

Oct. 12, 1992 [JP] Japan ..... 4-273140

[51] Int. Cl.[6] ..... G03G 15/00

[52] U.S. Cl. ..... 355/208; 355/246

[58] Field of Search ..... 355/208, 214, 355/216, 246, 219

[56] References Cited

U.S. PATENT DOCUMENTS

| | | | |
|---|---|---|---|
| 5,101,231 | 3/1992 | Saitoh | 355/246 X |
| 5,220,373 | 6/1993 | Kanaya | 355/208 X |
| 5,225,872 | 7/1993 | Fukushima | 355/208 |
| 5,298,943 | 3/1994 | Ide et al. | 355/208 |

FOREIGN PATENT DOCUMENTS

| | | | |
|---|---|---|---|
| 55-101968 | 8/1980 | Japan | 355/246 |

OTHER PUBLICATIONS

Otsuka, S., Organic Photoconductor—Its Electrophotographic Properties and Basic Physical Processes, Electrophotographic Society Bulletin, vol. 27, No. 4, 1988, pp. 588–594.

Katou, M., Measurment for Toner and Developer, Electrophotographic Society Bulletin, vol. 30, No. 2, 1991, pp. 158–167.

Kimura, M., Toner–Charge Measuring Method, Electrophotographic Society Bulletin, vol. 30, No. 2, 1991, pp. 168–171.

*Primary Examiner*—Joan H. Pendegrass
*Attorney, Agent, or Firm*—Cooper & Dunham

[57] ABSTRACT

An electrified portion electric-potential, exposed portion electric-potential, and developing biasing electric-potential are controlled so as to obtain a constant ratio between an input level in exposure to generate the electrostatic latent image and the density associated with the toner-made image resulting from the developing for said electrostatic latent image. A target electric-potential determination table obtains therefrom respective target values for the electrified portion electric-potential, exposed portion electric-potential, and developing biasing electric-potential, wherein the target values obtained may vary depending on variation in the relevant characteristics due to ambience and/or aging of the developing system. A control-input determination unit determines control-input for controlling the electrified portion electric-potential, exposed portion electric-potential and developing biasing electric-potential so that these potentials equal their respective target values.

15 Claims, 8 Drawing Sheets

| M/A | TC | 2.0 | 3.0 | --- |
|---|---|---|---|---|
| 0.2 | VD | 900 | 860 | --- |
| | VB | 700 | 680 | --- |
| | VL | 200 | 190 | --- |
| 0.3 | VD | 860 | 820 | --- |
| | VB | 680 | 660 | --- |
| | VL | 190 | 180 | --- |
| ⋮ | ⋮ | ⋮ | ⋮ | ⋱ |

ELECTROPHOTOGRAPHIC-PROCESS CONTROL APPARATUS HAVING IMPROVED OUTPUT-IMAGE-DENSITY CONTROL FUNCTION

BACKGROUND OF THE INVENTION

The present invention relates to an electrophotographic-process control apparatus for performing surface electric potential control of a photosensitive body used in an electrophotographic image forming apparatus such as a duplicator and printer. Such an electrophotographic image forming apparatus employs an electrophotographic process in the formation of an output image.

Some kinds of photosensitive bodies such as a selenium based photosensitive body or organic photosensitive body are often used in such electrophotographic image forming apparatuses. In such an electrophotographic image forming apparatus, an electrostatic latent image is formed on the photosensitive body by electrifying and exposing thereof. The formed electrostatic latent image is subsequently developed using developer by the developing system provided in the apparatus. In such an image forming process according to the related art, the following steps are currently used. An electrostatic-latent-image electric-potential comprising a difference between an electrified portion electric-potential and an exposed portion electric-potential is controlled so as to make it constant. Toner concentration in the developing system is controlled under the condition where the electrostatic-latent-image electrical-potential is constant. As a result, the density associated with the output image can be stabilized.

FIG. 2 shows an example of an electrophotographic image forming apparatus in the related art wherein an electrostatic-latent-image electric-potential is controlled so as to be constant.

In FIG. 2, a photosensitive drum body 1 is driven so as to be rotated by means of a driving unit and uniformly electrified by means of an electrifier 2. Then part of the surface of the photosensitive drum body 1 is exposed using a laser so as to form a pattern of an electrostatic latent image on the surface of the photosensitive drum body 1. The formed pattern of an electrostatic latent image is used as a reference for measuring electrified-portion electric-potential and exposed-portion electric-potential appearing on the surface of the photosensitive drum body 1. The electric-potential to be measured is measured by means of a surface-electric-potential sensor 4.

A control-input determination unit 5 varies an electrifying-grid-voltage control-input and an exposure-laser-voltage control-input. This variation is made so as to reduce a difference between measured electrified-portion electric-potential and a corresponding target electrified-portion electric-potential. This variation is made so as to also reduce the difference between the measured exposed-portion electric-potential and corresponding target exposed-portion electric-potential. The respective variation in the electrifying-grid-voltage control-input and exposure-laser-voltage control-input results in respective variation in grid voltage in the electrifier 2 and the laser voltage in an exposure device 3. The respective variation in grid voltage in the electrifier 2 and laser voltage in an exposure device 3 results in respective variation in the electrified-portion electric-potential and exposed-portion electric-potential on the surface of the photosensitive drum body 1.

Such an operation is performed repeatedly until the difference between the respective measured values of electric-potential and exposed-portion electric-potential and the respective target values thereof becomes within a predetermined allowable range.

FIG. 3 illustrates an example of an internal construction of the control-input determination unit 5.

A convergence determination unit 6 calculates the difference between the respective measured values of electric-potential and exposed-portion electric-potential and the respective target values thereof. The convergence determination unit 6 subsequently determines whether or not the difference becomes within a predetermined allowable range. The control-input determination unit 6 consequently obtains a necessary variation amount to which the relevant current control-input is added if the difference is outside of the predetermined allowable range. The result of the addition is used as the relevant subsequent control input of the electrified-portion electric-potential and exposed-portion electric-potential. The above-mentioned obtaining of the necessary variation amount is carried out by multiplying the difference with a control coefficient.

A number 2 (1991) of volume 30 of electrophotographic society bulletin, pp. 158–171 discloses a sensor for measuring an electrified amount in developer. However, this sensor is not a sensor for directly measuring the electrified amount in developer.

Such electrophotographic image forming apparatuses according to the related art as described above have a problem as described below. Such an electrophotographic image forming apparatus controls the electrostatic-latent-image electric-potential so as to make it constant. The apparatus subsequently attempts to stabilize the output-image density by controlling the developing-system toner-concentration under the conditions such as mentioned above. However electrified amounts in the respective color-toner particles and carrier particles may vary depending on the variation in ambience and/or aging of the apparatus. As a result, it is difficult to control a so-called printer gamma so as to make it constant, solely by means of the developing-system-toner-concentration control. The printer gamma comprises a ratio of the output-image density to the relevant input level (writing level) in the exposure process for generating the electrostatic latent image. Further, no sensor exists which can directly measure the respective electrified amounts in the toner particles and carrier particles. No means has completely been realized even for directly controlling the degree of electrification.

SUMMARY OF THE INVENTION

An object of the present invention is to provide an electrophotographic-process control apparatus wherein the printer gamma is stabilized by controlling the electrostatic-latent-image electric-potential.

To achieve the object of the present invention, an electrophotographic-process control apparatus according to an aspect of the present invention comprises:

a target electric-potential determination table for obtaining therefrom respective target values for said electrified portion electric-potential, exposed portion electric-potential, and developing biasing electric-potential, wherein said target values obtained may vary depending on variation in the relevant characteristics due to ambience and/or aging of said developing system; and control-input determination means for determining control-input for controlling said electrified portion electric-potential, exposed portion electric-potential and developing biasing electric-potential so as to be respective said target values.

By this construction, the electrostatic-latent-image electric-potential is varied so as to compensate the variation in the developing system. As a result, the toner-adhering-amount gamma value is controlled so as to be constant, the printer gamma value being thus stabilized. There the toner-adhering-amount gamma value comprises a relationship between the electrostatic-latent-image electric-potential generating the electrostatic latent image on said photosensitive body and an amount of the toner used in the toner image resulting from developing said electrostatic latent image.

An electrophotographic-process control apparatus according to another aspect of the present invention comprises:

surface-electric-potential control means for controlling the surface electric-potential made on said photosensitive body; and toner-concentration control means for controlling supplementation/removal of toner to said developing system so as to prevent toner concentration in said developing system from being either higher or lower than an appropriate toner concentration, where such a situation as highness/lowness in the toner concentration may result from variation in characteristics of the developer due to variation in environmental conditions.

By this construction, toner concentration in said developing system can be prevented from being either higher or lower, even when variation in environmental condition causes significant variation in characteristics of the developer.

An electrophotographic-process control apparatus according to another aspect of the present invention comprises:

a target electric-potential determination means for determining at least one of respective target values for said electrified portion electric-potential, exposed portion electric-potential, and developing biasing electric-potential, wherein said target values to be determined may vary depending on variation in the relevant characteristics due to ambience and/or aging of said developing system, said target electric-potential determination means comprising a neural network, wherein information is used for the determination, which information to be used comprises information concerning any group of values among a first group comprising the toner concentration in said developing system and an amount of the toner used in the toner image resulting from developing in a predetermined condition, a second group comprising any two of a so-called toner-adhering-amount gamma value, saturated electrostatic-latent-image electric-potential, and a saturated toner amount, a third group comprising ambient humidity and toner concentration in said developing system and a fourth group comprising the ambient humidity and an amount of the toner used in the toner image resulting from developing in a predetermined condition, wherein said saturated electrostatic-latent-image electric-potential comprises electrostatic-latent-image electric potential on said photosensitive body at which potential amounts of toner adhered thereon varying due to the electrostatic-latent-image electric-potential starts being saturated, wherein said saturated toner amount comprises an amount of toner adhered on said photosensitive body due to electrostatic-latent-image electric-potential applied thereon when said saturated electrostatic-latent-image electric-potential is applied on said photosensitive body, and wherein said toner-adhering-amount gamma value comprises a relationship between the electrostatic-latent-image electric-potential generating the electrostatic latent image on said photosensitive body and an amount of the toner used in the toner image resulting from developing said electrostatic latent image; and control-input determination means for determining a control-input for controlling at least one of said electrified portion electric-potential, exposed portion electric-potential and developing biasing electric-potential so as to make it correspond to said target value determined by said target electric-potential determination means.

By this construction, the appropriate variation in the electrostatic-latent-image electric-potential results in the stabilized printer gamma. Particularly, utilization of the neural network may reduce a number of samples to be obtained as a result of experiments to be carried out and/or may reduce development time. Such experiments and/or development time may be needed for realizing a suitable form of the target electric-potential determination means for carrying out the determination effectively.

The above-mentioned construction may further utilize a neural network in controlling the electrostatic-latent-image electric-potential. As a result, this control may be carried out speedily and effectively and reduction in time required for this control and prevention of the toner from being wasted may be consequently achieved.

In the above-mentioned construction, the target electric-potential determination means may use the residual electric potential of said photosensitive body for carrying out the relevant determination properly.

As a result, optimum electrostatic-latent-image electric-potential control can be achieved even when increase in the residual electric-potential may occur.

Other objects and further features of the present invention will become more apparent from the following detailed description when read in conjunction with the accompanying drawings.

DESCRIPTION OF THE PREFERRED EMBODIMENTS

In each of embodiments of an apparatus according to the present invention, an adhered toner amount is controlled so as to make it constant, where the adhered toner amount is a toner amount adhered in general on a recording sheet of paper as a result of developing of a electrostatic-latent-image which is formed on the photosensitive-body surface. The photosensitive body is used in an electrophotographic-process image forming apparatus in which an electrophotographic process is carried out so as to form an output image on a medium such as recording paper. Such an electrophotographic-process image forming apparatus may comprise an apparatus such as a duplicator and printer.

An adhered-toner-amount constant control such as mentioned above is carried out by varying electrostatic-latent-image electric-potential so as to compensate variation occurring in a developing system in the apparatus. A principle of an electrostatic-latent-image electric-potential control according to the present invention will now be described.

Figure 4:
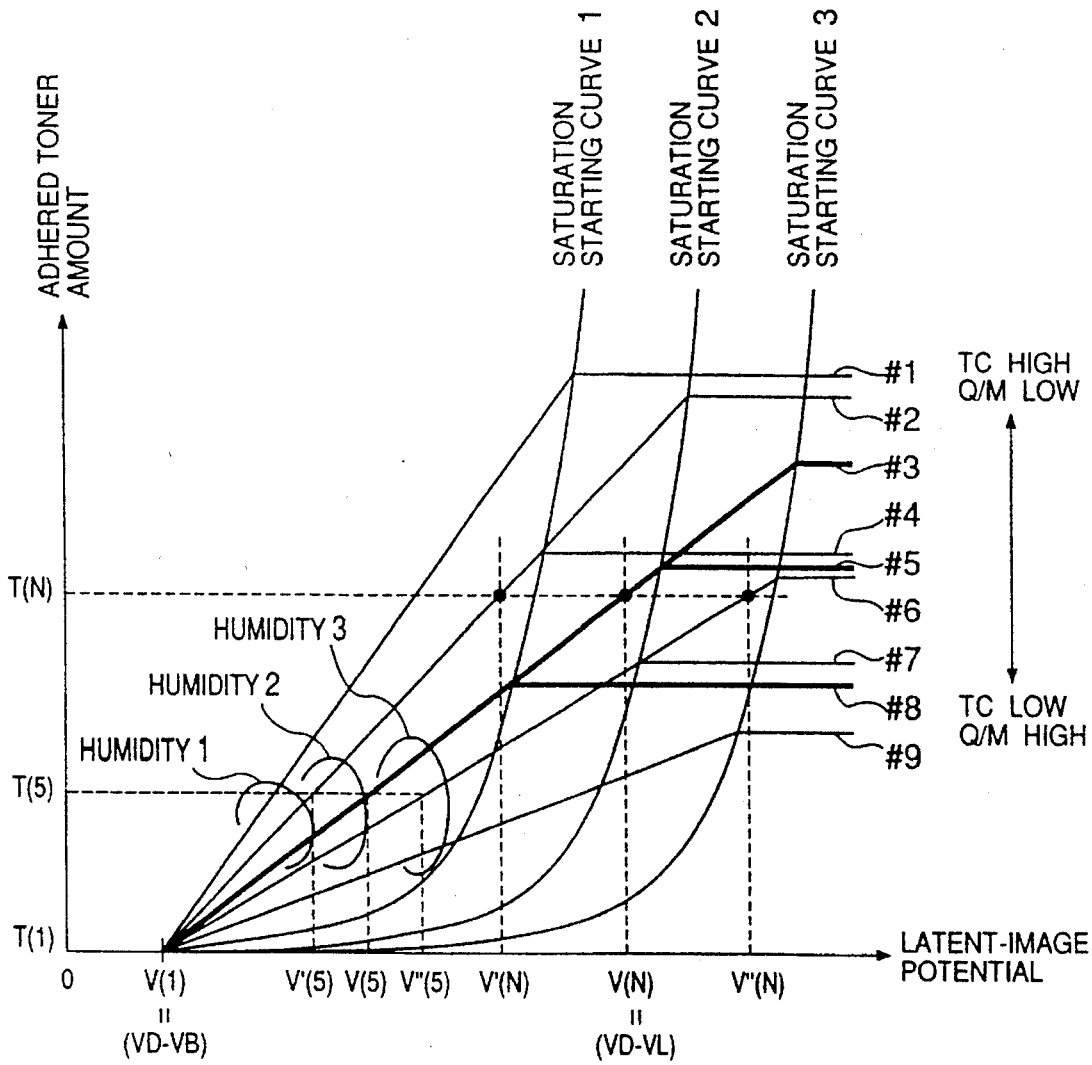
FIG. 4 shows a characteristic graph illustrating characteristics of adhered toner amounts to photosensitive-body surface electric-potentials in an electrophotographic-process image forming apparatus.

FIG. 4 illustrates example curves #1, #2, #3, #4, #5, #6, #7, #8 and #9 of relationships between the photosensitive-body surface electric-potentials (electrostatic-latent-image electric-potentials) and the resulting adhered-toner amounts. These examples of curves #1–#9 are for an electrophotographic-process image forming apparatus having a developing system in which an electrostatic-latent-image formed in a photosensitive-body surface is developed using two-component-system developer.

These curves #1–#9 shown in FIG. 4 are respectively called adhered-toner amount gamma curves. In these curves, the higher the photosensitive-body surface electric-potential becomes, starting from a developing starting potential V(1) and approaching a maximum writing potential V(N), the greater the resulting adhered-toner amount adhered on the photosensitive-body surface becomes as a result of the developing. There such an adhered-toner amount is saturated at a saturated adhered-toner amount when the surface electric-potential exceeds a saturation starting potential. Such saturated adhered-toner amount and saturated starting potential may vary depending on the relevant toner concentration TC and/or the relevant toner electrified amount Q/M. The respective curves #1, #4, and #8 are saturated at crossing points with a saturation starting curve 1; the respective curves #2, #5, and #7 are saturated at crossing points with a saturation starting curves 2; and the respective curves #3, #6 and #9 are saturated at crossing points with a saturation starting curve 3.

Such a toner concentration TC can be obtained as a ratio in weight of toner to carrier on a developing roller in a developing system described below. In an example of such a developing system, a magnet in the developing roller attracts two-component-system developer so as to form a magnetic brush while the developing roller is rotated. The formed magnetic brush is used for developing an electrostatic-latent-image formed on the photosensitive-body surface. Generally speaking, the higher the TC becomes, the higher the relevant saturated adhered-toner amount becomes.

Such a toner electrified amount Q/M as mentioned above is obtained as a ratio of a charge amount to a toner weight. The charge amount is generated as a result of toner is positively or negatively electrified by agitation friction between the toner and carrier or by an electrode. Generally speaking, the higher the Q/M becomes, the smaller becomes the resulting adhered-toner amount gamma (a gradient of the characteristics of the adhered-toner amount to the photosensitive-body surface electric-potential). Q/M varies greatly due to influence of environment, in particular, greatly due to ambient humidity. Further, Q/M is degraded due to aging of the relevant unit in the apparatus.

It is necessary to make the adhered-toner amount gamma be constant by controlling toner concentration, even if toner concentration varies or an environmental factor tends to vary the adhered-toner amount gamma. In a case where the potentials V(1) and V(N) are fixed, while the humidity varies starting from the humidity 1 and ending at the humidity 3 passing through the humidity 2, a corresponding adhered-toner amount gamma curve varies starting from the curve #3 and ended at the curve #8 through the curve #5. In the case of the curve #3, TC is so high that a toner splashing phenomenon tends to occur and consequently the output image may become dirty. Further, in the case of the curve #8, the target adhered-toner amount T(N) cannot be obtained at the maximum writing potential V(N).

In consideration of such conditions, the following operation method is applied in the present invention. In the case of a low Q/M state such as that at the humidity 1, the range of the electrostatic-latent-image electric-potential V(1)–V(N) is reduced so as to become the range V(1)–V'(N) and also the toner concentration is increased (by means of the toner-concentration correction unit 31/32 in the embodiment according to the present invention). Consequently it becomes possible to control the adhered-toner amount gamma so as to make it constant. In contrast to the case, that is, in the case of a high Q/M state such as that at the humidity 3, the range of the electrostatic-latent-image electric-potential V(1)–V(N) is extended so as to become the range V(1)–V"(N) and also the toner concentration is reduced (by means of the toner-concentration correction unit 31/32 in the embodiment according to the present invention). Consequently it becomes possible to control the adhered-toner amount gamma so as to make it constant.

The above control will now be described in detail, in which control the adhered-toner amount gamma (inclination) is made constant only by means of the toner-concentration control without carrying out the potential control (that is, the potential range is constant). In the case of low humidity in which case the gamma amount becomes low without making the level of the toner concentration high, the curve #3 of FIG. 4 is used so as to maintain the inclination, and the potential of the same range V(1)–V(N) is used, the level of the toner concentration is thus made high. Thus, this case may cause a problem such as a toner splashing phenomenon. In the case of average humidity, the curve #5 is used and the potential of the range V(1)–V(N) is used, and thus the level of the toner concentration becomes a proper level. In the case of high humidity in which the gamma amount becomes high without making the level of the toner concentration become low, the curve #8 of FIG. 4 is used so as to maintain the inclination, and the potential of the same range V(1)–V(N) is used, the level of the toner concentration thus becomes low. Thus, this case may cause a problem such as a level of toner which is too low. Thus, depending on humidity variation, the level of the toner concentration may become an improper level.

In contrast to this, if the potential control is employed (that is, the potential range is varied and the toner concentration is constant), the following operations are carried out. In the case of low humidity, the inclination, which becomes low in this case without altering the toner concentration, is not corrected and instead the potential range is increased to the range V(1)–V"(N) from the range V(1)–V(N). Consequently adhered-toner amount characteristics (the above-mentioned printer gamma) regarding the writing level are made effectively constant. As a result, the curve #6 is selected and the level of the toner concentration becomes a proper level. In the case of average humidity, the curve #5 is selected and the potential of the same range V(1)–V(N) is used, and thus the level of the toner concentration becomes a proper level. In the case of high humidity, the inclination, which becomes high in this case without altering the toner concentration, is not corrected and instead the potential range is reduced to the range V(1)–V'(N) from the range V(1)–V(N). Consequently adhered-toner amount characteristics (the above-mentioned printer gamma) regarding the writing level are made effectively constant. As a result, the curve #4 is selected and thus the level of the toner concentration becomes a proper level.

That is, in the related art, the potential range is constant while the toner concentration is controlled. In contrast to this, in the present invention, the potential is controlled while the toner concentration is constant. In the above-mentioned related-art method, the following problem may occur. That is, the level of the toner concentration may become too high or too low due to variation in the toner electrification characteristics caused by variation in ambient humidity. In contrast to this, in the above-mentioned present invention method, the above problem will not occur because the level of the toner concentration is constant. Further, in the present-invention method, the amount of the printer gamma can be made effectively constant due to the potential control.

However, there may be a case where it is necessary to change the potential sharply. In one example, there may be a case where the curve #6 has been used and the potential of the range of the V(1)–V"(N) is used, and thus the level of the toner concentration becomes a proper level. Then, it may be necessary to sharply change the potential from V"(N) to V'(N). As a result, temporarily, there is a status where the curve #1 is used and the potential of the range V(1)–V'(N) is used, and thus the toner concentration becomes a high level. Thus, the temporary status is a status in which the level of the toner concentration is too high. Then, in order to correct such an improper status, the toner-concentration correction unit 31/32 is used to make the improper toner concentration level a proper one. As a result, the status one in which of the curve #4 is used and the potential of the range V(1)–V'(N) is used, and thus the level of the toner concentration becomes a proper level.

It will now be explained why the level of the toner concentration changes from a proper one to an improper one (high one) when the status changes from that of the curve #6 (low humidity) to that of the curve #1 (high humidity). That is, the following relations exist among the toner concentrations:

(proper level of concentration at low humidity)> (proper level of concentration at average humidity)> (proper level of concentration at high humidity).

As a result, the level of the toner concentration changes from a proper one at low humidity to an improper one at high humidity.

In general, humidity alteration may not occur sharply. As a result, the toner-concentration control is first carried out so that a proper level of toner concentration can be maintained. Consequently, the toner-concentration correction unit may often not be needed. However, as described below, there may be a case where an ambient condition changes in a great deal from that of the previous night to that of the following morning when the-apparatus is switched on. Thus, there may temporarily occurs a level of toner concentration which is too high/too low. As a result, such a toner-concentration correction control as mentioned above is required.

As mentioned above, it is impossible to directly detect Q/M. However, it is possible to predict Q/M by the following steps. A reference pattern of toner-made image is formed on the photosensitive-body surface using a reference electric-potential such as, for example V(5). Subsequently the adhered-toner amount associated with the formed reference pattern of toner-made image is measured. Consequently the adhered-toner amount gamma curves #1, #2, #3, . . . can be known. As a result an optimum electrostatic-latent-image electric-potential can be determined and thus Q/M can be predicted.

In each of the embodiments according to the present invention, based on such a principle, the electrostatic-latent-image electric-potential is varied so as to compensate the variation in the developing system, accordingly the adhered-toner amount gamma being thus controlled to be constant.

A first embodiment of the apparatus according to the present invention will now be described with reference to FIG. 1.

Figure 1:
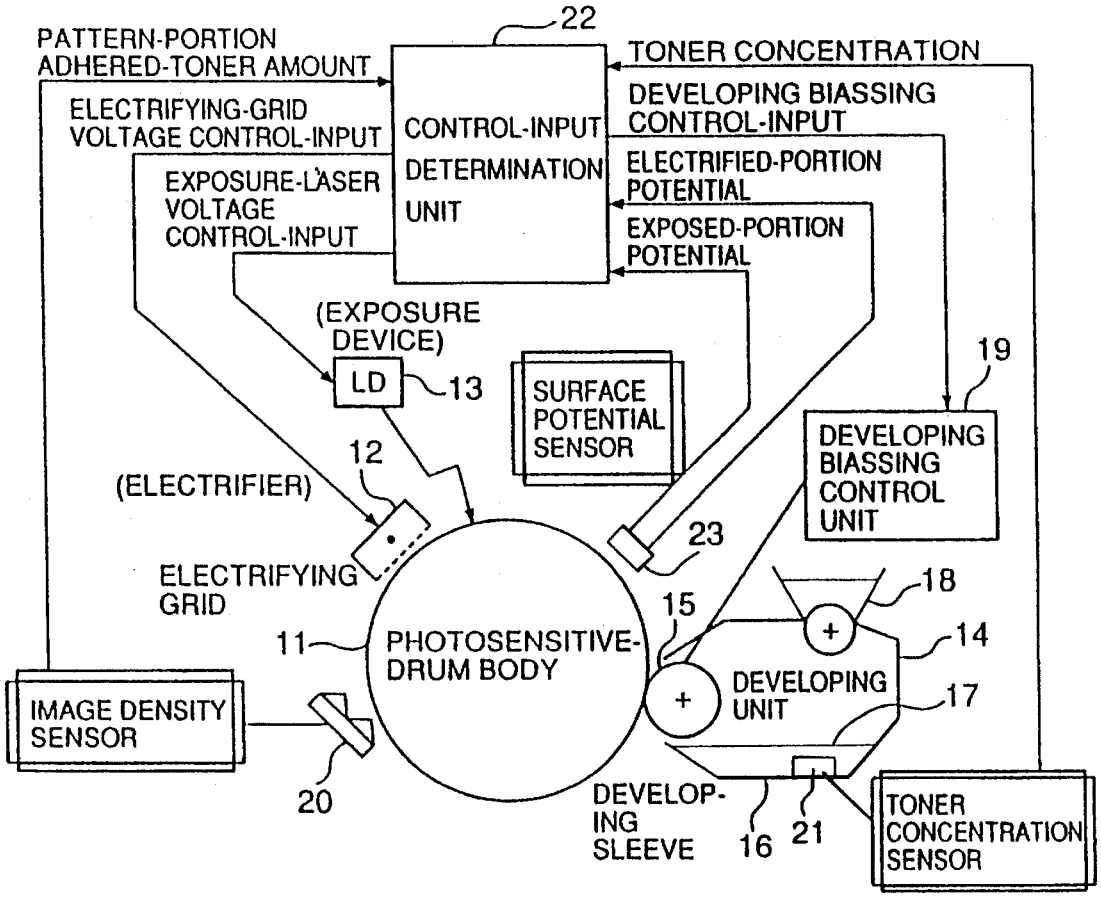
FIG. 1 diagrammatically shows a general construction of a first embodiment of an apparatus according to the present invention.
Figure 2:
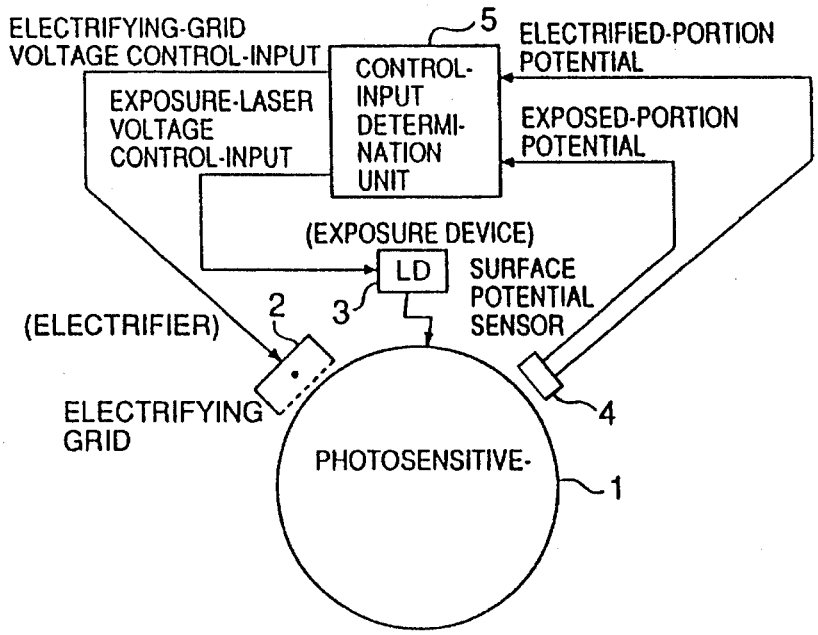
FIG.2 (PRIOR ART)
FIG. 2 diagrammatically shows a general construction of an example of an apparatus in the related art.
Figure 3:
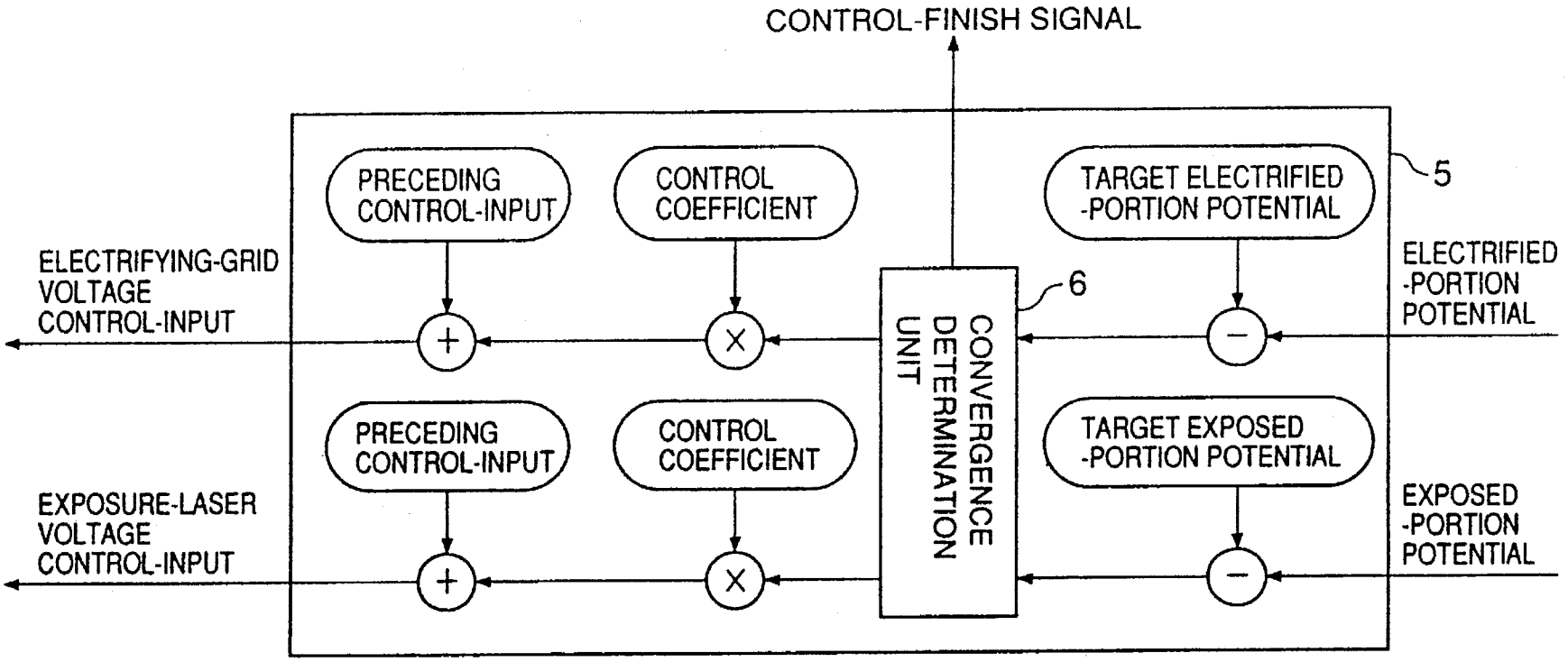
FIG.3 (PRIOR ART)
FIG. 3 shows a block diagram of the same example of the apparatus in the related art.

The apparatus of FIG. 1 comprises an electrophotographic-process control apparatus for controlling as mentioned above in an electrophotographic-process image forming apparatus, such as a duplicator or a printer, which employs an electrophotographic process. In the image forming apparatus, a photosensitive drum body 11 is driven so as to be rotated by a main motor. The photosensitive drum body 11 is further uniformly electrified and then a electrostatic-latent-image is formed the photosensitive-body surface thereof. This forming is carried out through exposing it using an exposure device 13. The exposure device 13 comprises, for example, a device which exposes the photosensitive-body surface of the drum 11 with laser light. The laser light is obtained from a laser which is modulated and driven according to a relevant image signal.

The electrostatic-latent-image formed on the photosensitive-body surface of the drum 11 is developed by a developing system 14. In this developing process the electrostatic-latent-image is developed with two-component-system developer so as to be a visible image (toner-made image). Subsequently the toner-made image is then transferred onto a recording sheet of paper (or a transferring sheet of paper) supplied by a paper supply device. Subsequently the image transferred on the sheet is fixed by a fixing device. Simultaneously the photosensitive drum body 11 is cleaned by a cleaning device so that toner still remaining thereon is removed.

The developing system 14 comprises, for example, a device having a developing roller 15. The two-component-system developer 17 in a developing vessel 16 is agitated by an agitator (not shown in the drawing). The developing roller 15 is driven so as to be rotated by a driving unit and developing biasing voltage is applied on the roller 15 by a developing biasing control unit 19. A magnet provided in the developing roller 15 attracts the developer 17 so that a magnetic brush is formed on the developing roller 15. A height of the formed magnetic brush is adjusted to be a constant height by a doctor or doctoring unit (not shown in the drawing). The height-adjusted magnetic brush is subsequently supplied to the photosensitive drum body 11 and is used to develop the electrostatic-latent-image formed on the surface of the photosensitive drum body 11. Toner is supplemented to the two-component-system developer 17 in the developing vessel 16 by a toner supplementation device 18 which is controlled by a toner-concentration control unit (not shown in the drawing). Thus the toner concentration of the developer 17 is stabilized.

In this first embodiment of the apparatus according to the present invention, an image density sensor 20 and toner concentration sensor 21 are employed, the output of these sensors is used to determine optimum electrostatic-latent-image electric-potential. The image density sensor 20 measures an amount of toner which is adhered on the surface of the photosensitive drum body 11, while the toner concentration sensor 21 measures the toner concentration of the developer 17 in the developing vessel 16. The respective output signals provided by the respective sensors 20 and 21 are sent to a target-potential determination table 24 shown in FIG. 5.

The target-potential determination table 24 is previously prepared as follows. Relationships between the photosensitive-body surface electric-potentials and the resulting adhered-toner amounts are obtained as a result of actual measurements in relevant experiments. Subsequently, using the obtained relationships based on the above-mentioned principle, an optimum electrostatic-latent-image electric-potential is determined for each toner concentration and for each adhered-toner amount both of which are detected.

That is, the target-potential determination table 24 is previously prepared using results of such experiments. This table 24 indicates relationships between the values to be detected and target electric potentials. The values to be detected comprise the toner concentration and adhered-toner amount. The target electric potentials comprise a target electrified-portion electric-potential, target exposed-portion electric-potential, both on the surface of the photosensitive drum body 11 and a target developing biasing electric-potential to be applied to the developing roller 15. The target-potential determination table 24 is used to obtain the target electrified-portion electric-potential, target exposed-portion electric-potential and target developing biasing electric-potential appropriately to make the adhered-toner amount gamma be constant. This computation is carried out using the detected toner concentration and adhered-toner amount. Further this computation process can substantially make the resulting target potentials reflect variation in environmental factors and/or in aging factors on the resulting target potentials.

Figures 6, 7:
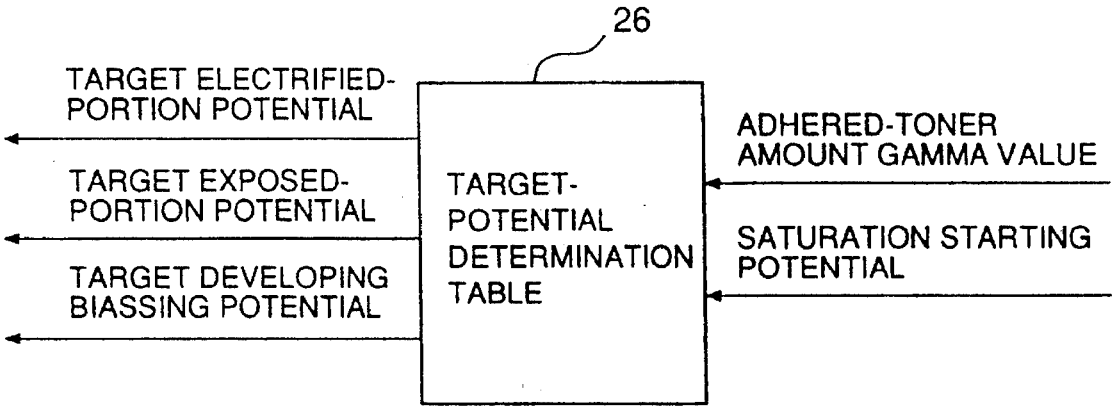
FIG. 6 shows an example of a target potential determination table in the above-mentioned control-input determination unit.
FIGS. 7, 8, 9, 10 and 11 respectively show block diagrams of target potential determination tables respectively used in a second, third, fourth, fifth and sixth embodiments of the apparatus according to the present invention.

FIG. 6 illustrates an example of the target-potential determination table 24. In FIG. 6 the electrified-portion electric-potential on the surface of the photosensitive drum body 11 is referred to as VD; an exposed-portion electric-potential on the surface of the photosensitive drum body 11 is referred to as VL; and the developing biasing electric-potential is referred to as VB. A surface potential sensor 23 shown in FIG. 1 is provided for measuring the surface electric-potential on the photosensitive drum body 11.

An operation of the first embodiment of the apparatus according to the present invention will now be described.

First the toner concentration of the developer 17 in the developing system 14 is measured by the toner concentration sensor 21. The photosensitive drum body 11 is uniformly electrified by the electrifier 12. Subsequently a reference pattern of an electrostatic latent image is formed on the photosensitive drum body 11 as a result of exposure by the exposure device 13. The reference pattern of an electrostatic latent image is then developed by the developing system 14 so as to be a visible image. Subsequently the adhered-toner amount associated with visible image is measured by the image density sensor 20.

As mentioned above, the respective output signals provided by the toner concentration sensor 21 and the image density sensor 20 are sent to the target-potential determination table 24 shown in FIG. 6 provided in a control-input determination unit 22. Using the sent output signals, the target electrified-portion electric-potential VD, target exposed-portion electric-potential VL, both on the photosensitive drum body 11, and the developing biasing electric-potential are obtained by the target-potential determination table 24 appropriately so as to make the adhered-toner amount gamma be constant.

Subsequently after the photosensitive drum body 11 is again uniformly electrified by the electrifier 12, the reference pattern of an electrostatic latent image is again formed thereon by the exposure by means of the exposure device 13. The electrified-portion electric-potential and exposed-portion electric-potential generating the formed pattern of an electrostatic latent image are measured by the surface potential sensor 23 and the corresponding measurement signals are subsequently sent to the control-input determination unit 22.

Figure 5:
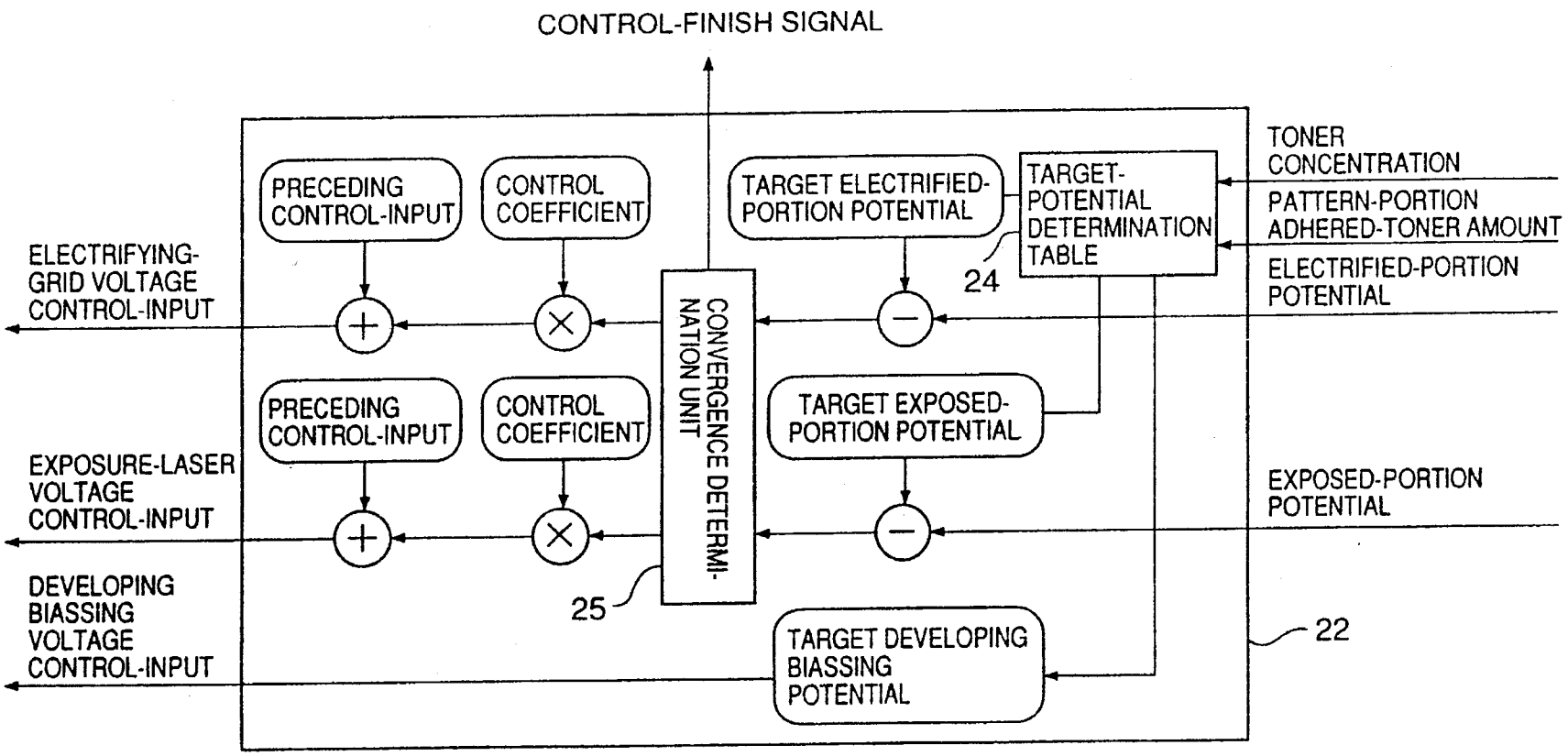
FIG. 5 shows a block diagram of a control-input determination unit of the above-mentioned first embodiment.

The control-input determination unit 22 then as shown in FIG. 5, calculates a difference between the target electrified-portion electric-potential obtained using the target-potential determination table 24 and the electrified-portion electric-potential measured through the surface potential sensor 23. The unit 22 also calculates a difference between the target exposed-portion electric-potential obtained using the target-potential determination table 24 and the exposed-portion electric-potential measured through the surface potential sensor 23. Subsequently the unit 22 determines, through a convergence determination unit 25, whether or not the obtained respective differences are within an (respective) allowable range(s). If the respective differences are outside the allowable range(s), then necessary control-input varying amounts are obtained by multiplying the respective differences with a (respective) control coefficient(s). The control-input determination unit 22 then obtains subsequent grid voltage control-input (for the electrifier 12) and laser voltage control-input (for the exposure device 13) by adding the obtained respective control-input varying amounts to current grid voltage control-input and laser voltage control-input. The obtained subsequent respective grid voltage control-input and laser voltage control-input are used to vary the respective grid voltage of the electrifier 12 and laser voltage of the exposure device 13 so as to vary the respective electrified-portion electric-potential and exposed-portion electric-potential both on the photosensitive drum body 11 accordingly.

The series of operations is repeated, which series comprises steps of: forming the reference-pattern of an electrostatic latent image; then measuring the electrified-portion electric-potential and exposed-portion electric-potential; and then determining the subsequent grid voltage control-input and laser voltage control-input. Then after the above-mentioned difference becomes within the allowable range(s), a control-finish signal is output by the control-input determination unit 22. The image forming apparatus employing the first embodiment of the control apparatus according to the present invention enters into an image-forming-process allowed state when it receives the control-finish signal from the control-input unit 22. Information concerning the target developing biasing electric-potential obtained using the target-potential determination table 24 is sent to the developing biasing control unit 19. The unit 19 then controls the developing biasing electric-potential applied to the developing roller 15 so as to make it be the target developing biasing electric-potential.

This first embodiment of the control apparatus according to the present invention will now be summarized. The control-input determination unit 22, using the target-potential determination table 24, the target electrified-portion electric-potential, the target exposed-portion electric-potential and the target developing biasing electric-potential operates to control the adhered-toner amount gamma be constant. This control is carried out using the respective output signals sent from the respective toner concentration sensor 21 and image density sensor 20. Further this control process can substantially make the resulting target potentials reflect variation in environmental factors and/or in aging factors on the resulting target potentials. Then the control-input determination unit 22 determines the respective grid voltage control-input and laser voltage control-input so that the actual electrified-portion electric-potential, exposed-portion electric-potential and developing biasing electric-potential are controlled to become the corresponding respective target values. As a result the electrostatic-latent-image electric-potential is varied so as to compensate the variation in the developing system, thus the adhered-toner amount gamma is able to be controlled so as to be constant. Consequently a steady printer gamma such as mentioned above can be maintained.

Figure 8:
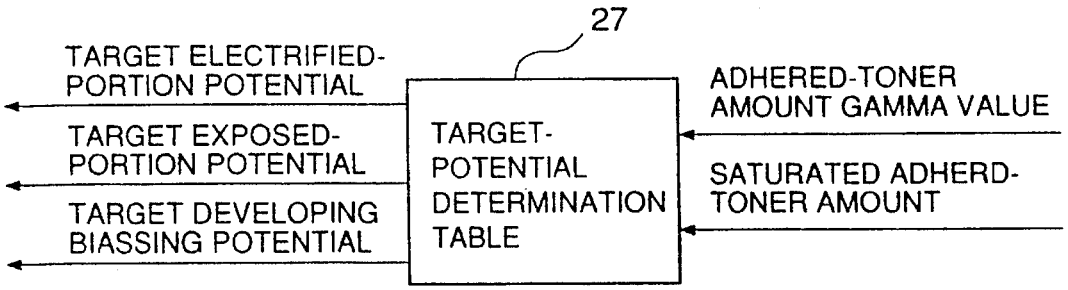
Figure 9:
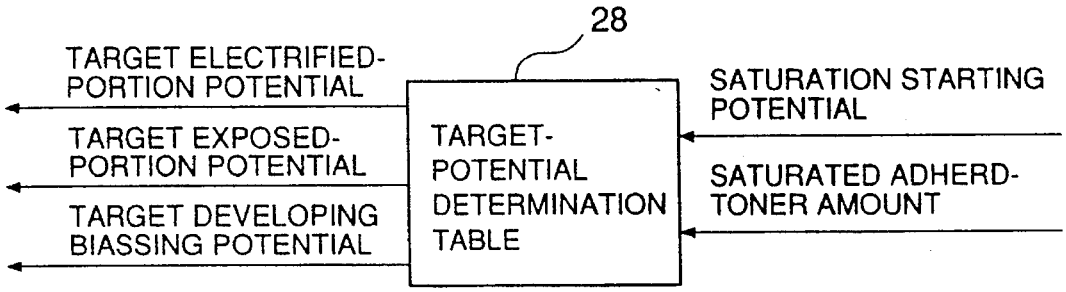

Respective FIGS. 7, 8 and 9 show input/output signals for respective target-potential determination tables according to a respective second, third, and fourth embodiments according to the present invention.

In the second to fourth embodiments, the target-potential determination table 24 employed in the above-mentioned first embodiment is replaced by respective target-potential determination tables 26, 27 and 28.

An adhered-toner amount gamma, saturated adhered-toner amount, and saturation starting potential can be obtained using results of measurement of relationship between the surface electric-potential on the photosensitive drum body 11 and the resulting adhered-toner amount as shown in FIG. 4, which measurement is carried out until the surface electric-potential reaches a certain potential where the adhered-toner amount on the photosensitive drum body 11 is saturated. The saturated adhered-toner amount is an adhered-toner amount on the photosensitive drum body 11 where the amount is saturated as mentioned above; and the saturation starting potential is an electrostatic-latent-image electric-potential where the adhered-toner amount on the photosensitive drum body 11 starts being saturated as mentioned above. The respective three values: the adhered-toner amount gamma, saturated adhered-toner amount and saturation starting potential are not independent from each other. That is, remaining one can be calculated from two values among the three values.

The above-mentioned toner concentration and toner electrified amount at a relevant time can be indirectly obtained using the three values at the relevant time: the adhered-toner amount gamma, saturated adhered-toner amount and saturation starting potential are not independent of each other. Consequently if any two of the three values are available through the image density sensor 20, it is sufficient to obtain the toner concentration and toner electrified amount indirectly. Further, optimum electrostatic-latent-image electric-potential can be determined, as mentioned above, using the toner concentration obtained and the adhered-toner amount associated with the toner-made image resulting from the reference-pattern-electrostatic-latent-image.

That is, in the second embodiment according to the present invention, the adhered-toner amount gamma and the saturation starting potential are input to the target-potential determination table 26. The table 26, using the input information, consequently outputs the target electrified-portion electric-potential, target exposed-portion electric-potential and target developing biasing electric-potential, which electric-potentials are appropriate so as to make the adhered-toner amount gamma be constant.

In the third embodiment according to the present invention, the adhered-toner amount gamma and the saturated adhered-toner amount are input to the target-potential determination table 27. The table 26, using the input information, consequently outputs the target electrified-portion electric-potential, target exposed-portion electric-potential and target developing biasing electric-potential, which electric-potentials are appropriate so as to make the adhered-toner amount gamma be constant.

In the fourth embodiment according to the present invention, the saturated adhered-toner amount and the saturation starting potential are input to the target-potential determination table 28. The table 26, using the input information, consequently outputs the target electrified-portion electric-potential, target exposed-portion electric-potential and target developing biasing electric-potential, which electric-potentials are appropriate so as to make the adhered-toner amount gamma be constant.

The contents of the respective target-potential determination tables 26, 27 and 28 are obtained by suitably changing contents, in the table shown in FIG. 6, concerning input data. That is, the contents of the target-potential determination table 26 are determined according to relationships between measurement values and target potentials appropriately so as to make the adhered-toner amount gamma be constant, which relationships are obtained from relevant experiments. The measurement values comprise the adhered-toner amount gamma and saturation starting potential value. The target potentials comprise the target electrified-portion electric-potential, target exposed-portion electric-potential and target developing biasing electric-potential. The resulting table 26 can be used to obtain the target electrified-portion electric-potential, target exposed-portion electric-potential and target developing biasing electric-potential appropriately so as to make the adhered-toner amount gamma be constant. This computation process uses the adhered-toner amount gamma and saturation starting potential as input thereto. Consequently this computation process can substantially make the resulting target potentials reflect variation in environmental factors and/or in aging factors on the resulting target potentials.

The contents of the target-potential determination table 27 are determined according to relationships between measurement values and target potentials appropriately so as to make the adhered-toner amount gamma be constant, which relationships are obtained from relevant experiments. The measurement values comprise the adhered-toner amount gamma and saturated adhered-toner amount. The target potentials comprise the target electrified-portion electric-potential, target exposed-portion electric-potential and target developing biasing electric-potential. The resulting table 27 can be used to obtain the target electrified-portion electric-potential, target exposed-portion electric-potential and target developing biasing electric-potential appropriately so as to make the adhered-toner amount gamma be constant. This computation process uses the adhered-toner amount gamma and saturated adhered-toner amount as input thereto. Consequently this computation process can substantially make the resulting target potentials reflect variation in environmental factors and/or in aging factors on the resulting target potentials.

The contents of the target-potential determination table 28 are determined according to relationships between measurement values and target potentials appropriately so as to make the adhered-toner amount gamma be constant, which relationships are obtained from relevant experiments. The measurement values comprise the saturated adhered-toner amount and saturation starting potential value. The target potentials comprise the target electrified-portion electric-potential, target exposed-portion electric-potential and target developing biasing electric-potential. The resulting table 28 can be used to obtain the target electrified-portion electric-potential, target exposed-portion electric-potential and target developing biasing electric-potential appropriately so as to make the adhered-toner amount gamma be constant. This computation process uses the saturated adhered-toner amount and saturation starting potential as input thereto. Consequently this computation process can substantially make the resulting target potentials reflect variation in environmental factor and/or in aging factor on the resulting target potentials.

Figure 10:
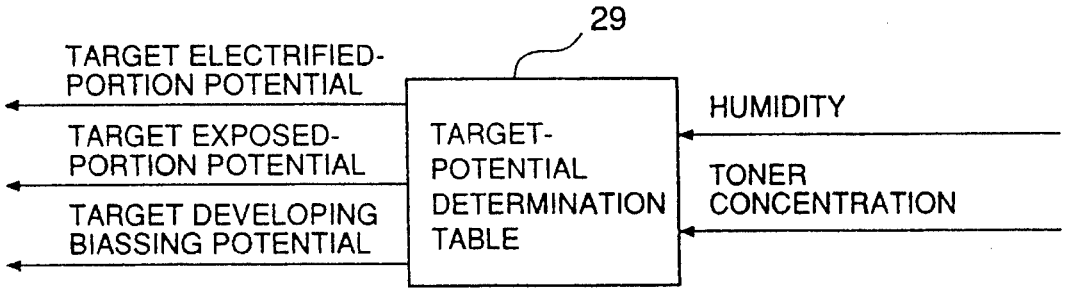
Figure 11:
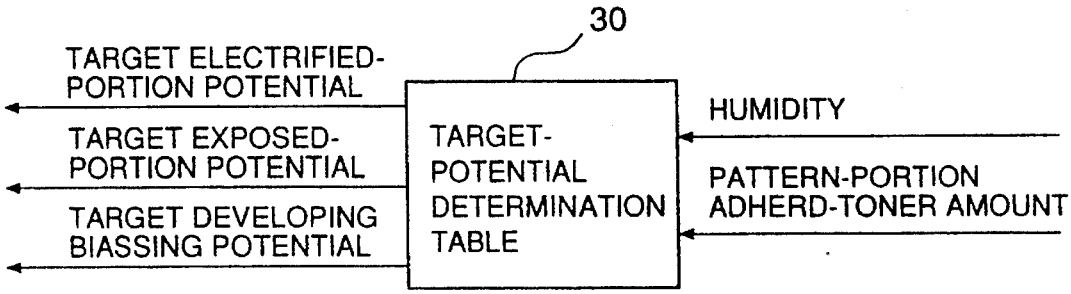

Respective FIGS. 10 and 11 show input/output signals for respective target-potential determination tables according to a respective fifth and sixth embodiments according to the present invention.

In the fifth and sixth embodiments, the target-potential determination table 24 employed in the above-mentioned first embodiment is replaced by respective target-potential determination tables 29 and 30. Further, in each of the fifth and sixth embodiments, a humidity sensor is provided. As mentioned above, the toner electrified amount has a strong correlation to ambient humidity. As a result target potentials such as mentioned above can be determined if a pair of values concerning respective ambient humidity and the toner concentration or a pair of values concerning respective ambient humidity and the adhered-toner amount associated with the toner-made image resulting from the reference pattern of an electrostatic latent image. The target potentials comprise the target electrified-portion electric-potential, target exposed-portion electric-potential and target developing biasing electric-potential.

The respective fifth and sixth embodiments utilize such principle. In the fifth embodiment according to the present invention, humidity in the developing system 14 is measured by the humidity sensor. Subsequently the respective output signals from the humidity sensor and from the above-mentioned toner concentration sensor 21 are input to the target-potential determination table 29. The table 29, using information from the input signals, consequently outputs the target electrified-portion electric-potential, target exposed-portion electric-potential and target developing biasing electric-potential, which electric-potentials are appropriate so as to make the adhered-toner amount gamma be constant.

In the sixth embodiment according to the present invention, humidity in the developing system 14 is measured by the humidity sensor. Subsequently the respective output signals from the humidity sensor and from the above-mentioned image density sensor 20 are input to the target-potential determination table 30. The table 30, using information from the input signals, consequently outputs the target electrified-portion electric-potential, target exposed-portion electric-potential and target developing biasing electric-potential, which electric-potentials are appropriate so as to make the adhered-toner amount gamma be constant.

The contents of the respective target-potential determination tables 29 and 30 are obtained by suitably changing contents concerning input data in the table shown in FIG. 6. That is, the contents of the target-potential determination table 29 are determined according to relationships between measurement values and target potentials appropriately so as to make the adhered-toner amount gamma be constant. These relationships are obtained from relevant experiments. The measurement values comprise the humidity and toner concentration. The target potentials comprise the target electrified-portion electric-potential, target exposed-portion electric-potential and target developing biasing electric-potential. The resulting table 29 can be used to obtain the target electrified-portion electric-potential, target exposed-portion electric-potential and target developing biasing electric-potential appropriately so as to make the adhered-toner amount gamma be constant. This computation process uses the humidity and toner concentration as input thereto. Consequently this computation process can substantially make the resulting target potentials reflect variation in environmental factor and/or in aging factor on the resulting target potentials.

The contents of the target-potential determination table 30 are determined according to relationships between measurement values and target potentials appropriately so as to make the adhered-toner amount gamma constant, which relationships are obtained from relevant experiments. The measurement values comprise the humidity and the adhered-toner amount associated with the toner-made image resulting from the reference pattern of the electrostatic latent image. The target potentials comprise the target electrified-portion electric-potential, target exposed-portion electric-potential and target developing biasing electric-potential. The resulting table 30 can be used to obtain the target electrified-portion electric-potential, target exposed-portion electric-potential and target developing biasing electric-potential appropriately so as to make the adhered-toner amount gamma be constant. This computation process uses the humidity and the adhered-toner amount associated with the toner-made image resulting from the reference pattern of an electrostatic latent image as input thereto. Consequently this computation process can substantially make the resulting target potentials reflect variation in environmental factors and/or in aging factors on the resulting target potentials.

Figure 12:
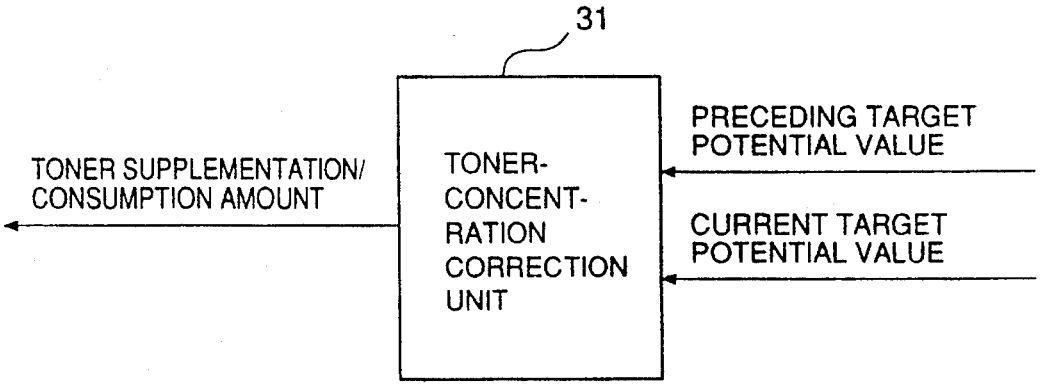
FIGS. 12 and 13 respectively show block diagrams of toner-concentration correction units respectively used in a seventh and an eighth embodiment of the apparatus according to the present invention.
Figure 13:
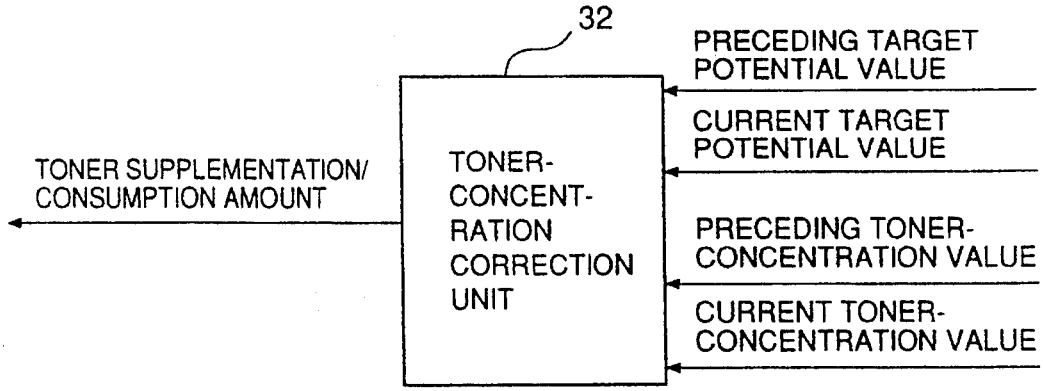

Respective FIGS. 12 and 13 show input/output signals for toner-concentration correction units 31 and 32 used in respective seventh and eighth embodiments of the control apparatus according to the present invention.

In the respective seventh and eighth embodiments the respective toner-concentration correction units 31 and 32 are added to the above-mentioned first embodiment of the control apparatus. These respective embodiments respectively act to eliminate the following problem which may occur in the first embodiment of the apparatus. The problem is the occurrence of a higher or lower toner concentration being in the developing vessel 16 than an appropriate toner concentration. This problem may occur during the following operations being carried out. That is, the control-input determination unit 22 determines the target electrified-portion electric-potential, target exposed-portion electric-potential, and target developing biasing electric-potential using the target-potential determination table 24. Subsequently the unit 22 controls electrostatic-latent-image electric-potential by as appropriate varying the grid voltage control-input for the electrifier 12 and the laser voltage control-input for the exposure device 13. The above-mentioned problem may occur as a result of, for example, occurrence of violent variation in environmental conditions. The toner concentration control in the above mentioned first embodiment of the control apparatus according to the present invention cannot follow such violent variation in environmental conditions temporarily immediately after occurrence thereof. Thus the above-mentioned problem of occurrence of undesirable toner concentration may occur.

In an example, such a problem may occur in the following situation. That is, ambient humidity during the preceding day is relatively low and then it rains during the night. As a result ambient humidity increases during the following morning. In this case first the apparatus is in the state indicated by the curve #6 shown in FIG. 4 due to the low humidity and then the apparatus enters into the state indicated by the curve #4 due to the increased humidity. The apparatus consequently varies the electrostatic-latent-image electric-potential from V"(N) to V'(N) so as to adapt the apparatus to this different state.

There, the toner concentration needed for the state indicated by the curve #6 is higher than the toner concentration needed for the state indicated by the curve #4. As a result, the current toner concentration is higher than the toner concentration needed for the current #4-curve state temporarily immediately after the variation in the electrostatic-latent-image electric-potential from V"(N) to V'(N) being performed, as mentioned above.

In contrast to the above situation, in an example where ambient humidity falls violently, that is, for example, the state of the apparatus changes from the #4-curve state to the #6-curve state, the control apparatus attempts to adapt the electrophotographic-process to the subsequent different #6-curve state in response to the variation of state. Then the current toner concentration is temporarily lower than the toner concentration needed for the current #6-curve state.

Such difference, due to variation in environmental conditions, in the toner concentration needed for the apparatus state may occur for the following reason. Variation in environmental conditions, in particular humidity may affect the toner electrified amount so as to make it vary as mentioned above. The variation in the toner electrified amount results in difference in electrostatic attraction between the toner and carrier. As a result a toner amount which can be supplied for the developing process may vary even if the toner concentration is constant and electrostatic-latent-image electric-potential is constant.

In the respective seventh and eighth embodiments, the respective toner-concentration correction units 31 and 32 are provided to compensate for such a temporary higher/lower toner concentration. Each of the toner-concentration correction units 31 and 32 basically forcibly supplements/consumes toner so as to make the current toner concentration be the optimum toner concentration.

In the seventh embodiment, as shown in FIG. 12, the toner-concentration correction unit 31 watches variation in the target electrostatic-latent-image electric-potentials obtained through the target-potential determination table 24. This variation in the target electrostatic-latent-image electric-potentials comprises a difference between the preceding target electrostatic-latent-image electric-potentials and the current target electrostatic-latent-image electric-potentials. If the variation amount exceeds a predetermined threshold value, forced toner supplementation/consumption is carried out so as to compensate shortage/surplus in the toner concentration occurring together with the performed variation in the target electrostatic-latent-image electric-potential. In this embodiment, the forced toner-supplementation is carried out by activating the toner supplementation device 18 provided in the developing system 14. The forced toner-consumption is carried out by making toner contained in the developing vessel 16 partially adhere onto the photosensitive drum body 11 using the developing system 14. The adhered toner is subsequently collected by the cleaning device.

In the eighth embodiment of the control apparatus according to the present invention, as shown in FIG. 13, the toner-concentration correction unit 32 monitors variation in the target electrostatic-latent-image electric-potentials obtained through the target-potential determination table 24. This variation in the target electrostatic-latent-image electric-potentials comprise a difference between the preceding target electrostatic-latent-image electric-potentials and the current target electrostatic-latent-image electric-potentials. If the variation amount exceeds a predetermined threshold value, forced toner supplementation/consumption is carried out so as to compensate shortage/surplus in the toner concentration occurring together with the performed variation in the target electrostatic-latent-image electric-potential.

The toner-concentration correction unit 32 also watches variation in the toner concentration detected through the toner concentration sensor 32, which variation in the toner concentration comprises a difference between the preceding detected toner concentration and the current detected toner concentration. If the variation amount exceeds a predetermined threshold value, forced toner supplementation/consumption is carried out so as to compensate shortage/surplus in the toner concentration. In this eighth embodiment, the forced toner-supplementation is carried out by activating the toner supplementation device 18 provided in the developing system 14. The forced toner-consumption is carried out by making toner contained in the developing vessel 16 partially adhere onto the photosensitive drum body 11 using the developing system 14. The adhered toner is subsequently collected by the cleaning device.

In the seventh embodiment of the control apparatus according to the present invention, the above mentioned function of the toner-concentration correction unit 31 is incorporated into the above-mentioned first embodiment of the control apparatus. In respective ninth, tenth, eleventh, twelfth and thirteenth embodiments of the control apparatus according to the present invention, the above mentioned function of the toner-concentration correction unit 31 is incorporated into the above-mentioned respective second, third, fourth, fifth and sixth embodiments of the control apparatus.

In the eighth embodiment of the control apparatus according to the present invention, the above mentioned function of the toner-concentration correction unit 32 is incorporated into the above-mentioned first embodiment of the control apparatus. In respective fourteenth, fifteenth, sixteenth, seventeenth and eighteenth embodiments of the control apparatus according to the present invention, the above mentioned function of the toner-concentration correction unit 32 is incorporated into the above-mentioned respective second, third, fourth, fifth and sixth embodiments of the control apparatus.

In a nineteenth embodiment of the control apparatus according to the present invention, an output unit is further provided into the toner-concentration correction unit 31 in the seventh embodiment of the control apparatus. This output unit provides a signal for forcibly making the above-mentioned toner-concentration control unit carry out toner-concentration control so as to compensate the shortage or excess in toner concentration based on the above-mentioned function of the correction unit 31. The toner-concentration control unit, according to the reception of the signal sent from the output unit, controls the toner supplementation device 18. Thus, the toner-concentration control unit controls the current toner concentration so as to make it be a target toner concentration. It is also possible to modify the above-mentioned respective ninth to thirteenth embodiments of the control apparatus so as to make them incorporate therein the above-mentioned function of the output unit and function of the toner-concentration control unit such as that carried out in the nineteenth embodiment.

In a twentieth embodiment of the control apparatus according to the present invention, an output unit is further provided into the toner-concentration correction unit 32 in the eighth embodiment of the control apparatus. This output unit provides a signal for forcibly making the above-mentioned toner-concentration control unit carry out toner-concentration control so as to compensate the shortage or excess in toner concentration based on the above-mentioned function of the correction unit 32. The toner-concentration control unit, according to the reception of the signal sent from the output unit, controls the toner supplementation device 18. Thus, the toner-concentration control unit controls the current toner concentration so as to make it be a target toner concentration. It is also possible to modify the above-mentioned respective fourteenth to eighteenth embodiments of the control apparatus so as to make them incorporate therein the above-mentioned function of the output unit and function of the toner-concentration control unit such as that carried out in the twentieth embodiment.

In a twenty-first embodiment of the control apparatus according to the present invention, a neural network is used, instead of the target-potential determination table 24, in the above-mentioned first embodiment of the control apparatus. The neural network comprises a neural network which has already been made to learn appropriately using as teacher data target electrified-portion electric-potential, target exposed-portion electric-potential and target developing biasing electric-potential. These target electric-potentials to be used as teacher data are those optimum with respect to the given toner concentration and adhered-toner amount associated with the toner-made image formed from the reference-pattern electrostatic-latent-image electric-potential. These optimum target electric-potentials are those determined as a result of relevant experiments.

Figure 14:
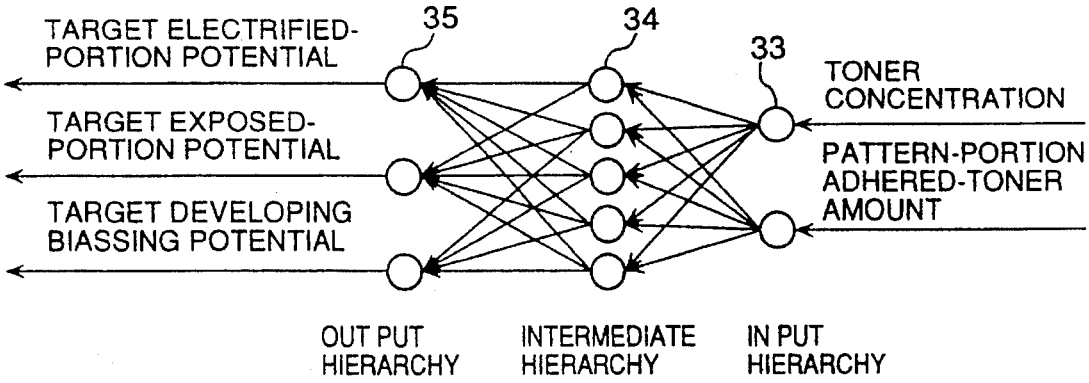
FIG. 14 diagrammatically shows a neural network used in a twenty-first embodiment of the apparatus according to the present invention.

This neural network comprises a neural network such as for example that shown in FIG. 14, that is, a multi-layer perception type neural network having input layer 33, intermediate layer 34, and output layer 35. An error back propagation method is used as learning algorithm for this learning for example. It is also possible to modify each of the above-mentioned second to sixth embodiments so as to replace the target-potential determination table 24 by such a neural network. Utilization of such a neural network may reduce a number of samples to be obtained as a result of experiments to be carried out and/or may reduce a time required for developing such an electrophotographic-process control apparatus.

A twenty-second embodiment of the control apparatus according to the present invention can eliminate the following problems which may occur in the above-mentioned first to twenty-first embodiments. The problem results from the feed-back control system being employed these embodiments. The employed feedback control system is such as the electric-potential control unit as shown in FIG. 1 using the target-potential determination table 24. In such a feed-back control system, repeating of the series of steps comprising starting from the step of forming the reference-pattern electrostatic-latent-image electric-potential and ending at the step of carrying out the necessary measurement is needed. As a result of such repetition, corresponding time is required therefor and corresponding toner consumption is also required therefor. In particular, the control repetition rate which is high for electric-potential control is to be carried out each time a change in the electrostatic-latent-image electric-potential on the photosensitive drum body 11 occurs. Such a high control repetition rate of the repeated feed-back control operations causes delay of a time when a net image forming process can be started. That is, none of the substantial image forming processes such as for example a duplicating (taking a hard copy) process can be carried out during this time required for the high-repetition rate control process.

Figure 15:
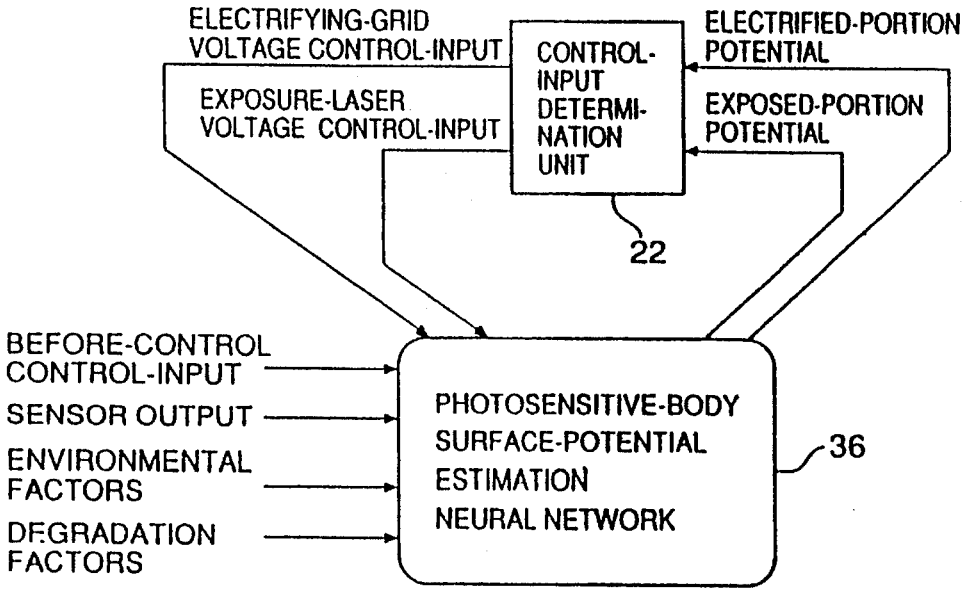
FIG. 15 shows a block diagram of a twenty-second embodiment of the apparatus according to the present invention.
Figure 16:
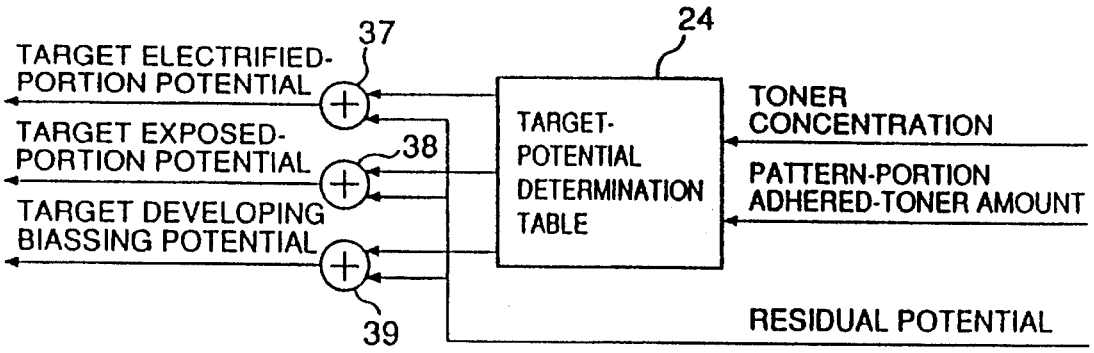
FIG. 16 shows a block diagram of a control-input determination unit used in a twenty-third embodiment of the apparatus according to the present invention.

In the twenty-second embodiment of the control apparatus according to the present invention, a neural network 36 shown in FIG. 15 for presuming current surface electric-potential on the photosensitive drum body 11. This neural network 36 is used for controlling electrostatic-latent-image electric-potential on the photosensitive drum body 11. Such a composition enables elimination of time consumption and toner consumption such as mentioned above. Various input values such as a those described below are input to the neural network 36. The various input values may comprise detection values obtained through various kinds of sensors for detecting variation characteristics in the developing system, which sensors comprise those such as for example the image density sensor 30 and toner concentration sensor 21. The various input values may also comprise various control-input values which comprise the electrifying grid control-input and the exposure-laser voltage control-input, both prior to the relevant control process; and the electrifying grid control-input and the exposure-laser voltage control-input, both provided from the control-input determination unit 22. The neural network 36 provides as presumed values the electrified-portion electric-potential and exposed-portion electric-potential.

This neural network 36 comprises a neural network which has already been made to learn the electrifying exposure characteristics of the photosensitive drum body 11. That is, the neural network used as the neural network 36 has already learnt appropriately for accurate estimation using the following data as teacher data. The teacher data used comprises suitable estimation values. These estimation values are those determined as a result of relevant experiments. These estimation values comprise the current electrified-portion electric-potential and exposed-portion electric-potential resulting from the given detecting values obtained through various sensors such as mentioned above; the electrifying grid control-input, exposure-laser voltage control-input, both prior to the relevant control process; the electrifying grid control-input, exposure-laser voltage control-input, both provided from the control-input determination unit 22.

It is also possible to modify the above-mentioned second to sixth embodiments so as to utilize a photosensitive-body surface electric-potential estimation neural network such as the neural network 36 such as used in the twenty-second embodiment so as to control the electrostatic-latent-image electric-potential on the photosensitive drum body 11.

A twenty-third embodiment of the control apparatus according to the present invention is that which results from modifying the above-mentioned first embodiment. In the twenty-third embodiment, the following phenomenon is considered. That is, generally speaking, residual change is accumulated in a photoconductive layer of the photosensitive drum body 11 as a result of long-term use thereof. Such residual change may result in increase of the electrified-portion electric-potential and exposed-portion electric-potential. An electric-potential difference due to such electric-potential increase is called residual electric-potential.

In the twenty-third embodiment, such residual electric-potential is appropriately reflected in the electrophotographic-process control process. For this purpose, adding units 37, 38 and 39 are provided for adding the residual electric-potential to the respective target electrified-portion electric-potential, target exposed-portion electric-potential and target developing biasing electric-potential which electric-potentials are obtained through the target-potential determination table 24. The results of the adding are then used as the current target electrified-portion electric-potential, target exposed-portion electric-potential and target developing biasing electric-potential which electric-potentials to be used for the relevant electrophotographic-process control.

It is also possible to modify the above-mentioned respective second to sixth embodiments so as to incorporate the above-mentioned functions offered by the adding units 37–39 such as those used in the above-mentioned twenty-third embodiment.

Further, the present invention is not limited to the above described embodiments, and variations and modifications may be made without departing from the scope of the present invention.

What is claimed is:

1. An electrophotographic-process control apparatus used in an electrophotographic process wherein an electrostatic latent image is generated on a photosensitive body through electrostatic-latent-image electric-potential comprising a difference between an electrified portion electric-potential and an exposed portion electric-potential, and said electrostatic latent image generated is then developed so as to generate a toner image by a developing system having a developer using developing biasing electric-potential, said electrophotographic-process control apparatus controlling said electrified portion electric-potential, exposed portion electric-potential, and developing biasing electric-potential so as to obtain a constant ratio between an input level in exposure to generate the electrostatic latent image and density associated with the toner-made image resulting from the developing of said electrostatic latent image, said electrophotographic-process control apparatus comprising:

a target electric-potential determination table for obtaining therefrom respective target values for said electrified portion electric-potential, exposed portion electric-potential, and developing biasing electric-potential, wherein said target values are determined by detecting actual characteristics as to how the toner has adhered on said photosensitive body; and control-input determination means for determining control-input for controlling said electrified portion electric-potential, exposed portion electric-potential and developing biasing electric-potential so as to respectively be said target values.

2. An electrophotographic-process control apparatus used in an electrophotographic process wherein an electrostatic latent image is generated on a photosensitive body through electrostatic-latent-image electric-potential comprising a difference between an electrified portion electric-potential and an exposed portion electric-potential, and said electrostatic latent image generated is then developed so as to generate a toner image by a developing system through a developer using developing biasing electric-potential, said electrophotographic-process control apparatus controlling said electrified portion electric-potential, exposed portion electric-potential, and developing biasing electric-potential so as to obtain a constant ratio between an input level in exposure to generate the electrostatic latent image and density associated with the toner-made image resulting from the developing of said electrostatic latent image, said electrophotographic-process control apparatus comprising:

a target electric-potential determination table for obtaining therefrom respective target values for said electrified portion electric-potential, exposed portion electric-potential, and developing biasing electric-potential, wherein said target values obtained may vary depending on variation in the relevant characteristics due to ambience and/or aging of said developing system; and control-input determination means for determining control-input for controlling said electrified portion electric-potential, exposed portion electric-potential and developing biasing electric-potential so as to respectively be said target values; and wherein said target electric-potential determination table is such that said target values may be obtained by reading the relevant portions therein according to a concentration of toner of said developer to be used for the developing and according to an amount of the toner used in the toner image resulting from developing in a predetermined condition.

3. An electrophotographic-process control apparatus used in an electrophotographic process wherein an electrostatic latent image is generated on a photosensitive body through electrostatic-latent-image electric-potential comprising a difference between an electrified portion electric-potential and an exposed portion electric-potential, and said electrostatic latent image generated is then developed so as to generate a toner image by a developing system through a developer using developing biasing electric-potential, said electrophotographic-process control apparatus controlling said electrified portion electric-potential, exposed portion electric-potential, and developing biasing electric-potential so as to obtain a constant ratio between an input level in exposure to generate the electrostatic latent image and density associated with the toner-made image resulting from the developing of said electrostatic latent image, said electrophotographic-process control apparatus comprising:

a target electric-potential determination table for obtaining therefrom respective target values for said electrified portion electric-potential, exposed portion electric-potential, and developing biasing electric-potential, wherein said target values obtained may vary depending on variation in the relevant characteristics due to ambience and/or aging of said developing system; and control-input determination means for determining control-input for controlling said electrified portion electric-potential, exposed portion electric-potential and developing biasing electric-potential so as to respectively be said target values; and wherein said target electric-potential determination table is such that said target values may be obtained by reading values therein according to two values comprising a first value concerning a relationship between the electrostatic-latent-image electric-potential generating the electrostatic latent image on said photosensitive body and an amount of the toner used in the toner image resulting from developing said electrostatic latent image, and a second value concerning a saturated electrostatic-latent-image electric-potential on said photosensitive body at which potential amounts of toner adhered thereon varying due to the electrostatic-latent-image electric-potential starts being saturated.

4. An electrophotographic-process control apparatus used in an electrophotographic process wherein an electrostatic latent image is generated on a photosensitive body through electrostatic-latent-image electric-potential comprising a difference between an electrified portion electric-potential and an exposed portion electric-potential, and said electrostatic latent image generated is then developed so as to generate a toner image by a developing system through a developer using developing biasing electric-potential, said electrophotographic-process control apparatus controlling said electrified portion electric-potential, exposed portion electric-potential, and developing biasing electric-potential so as to obtain a constant ratio between an input level in exposure to generate the electrostatic latent image and density associated with the toner-made image resulting from the developing of said electrostatic latent image, said electrophotographic-process control apparatus comprising:

a target electric-potential determination table for obtaining therefrom respective target values for said electrified portion electric-potential, exposed portion electric-potential, and developing biasing electric-potential, wherein said target values obtained may vary depending on variation in the relevant characteristics due to ambience and/or aging of said developing system; and control-input determination means for determining control-input for controlling said electrified portion electric-potential, exposed portion electric-potential and developing biasing electric-potential so as to respectively be said target values; and wherein said target electric-potential determination table is such that said target values may be obtained by reading values therein according to two values comprising a first value concerning a relationship between the electrostatic-latent-image electric-potential generating the electrostatic latent image on said photosensitive body and an amount of the toner in the toner image resulting from developing for said electrostatic latent image, and a second value concerning an amount of toner adhered on said photosensitive body due to electrostatic-latent-image electric-potential thereon when amounts of toner adhered thereon varying due to the electrostatic-latent-image electric-potential starts being saturated.

5. An electrophotographic-process control apparatus used in an electrophotographic process wherein an electrostatic latent image is generated on a photosensitive body through electrostatic-latent-image electric-potential comprising a difference between an electrified portion electric-potential and an exposed portion electric-potential, and said electrostatic latent image generated is then developed so as to generate a toner image by a developing system through a developer using developing biasing electric-potential, said electrophotographic-process control apparatus controlling said electrified portion electric-potential, exposed portion electric-potential, and developing biasing electric-potential so as to obtain a constant ratio between an input level in exposure to generate the electrostatic latent image and density associated with the toner-made image resulting from the developing of said electrostatic latent image, said electrophotographic-process control apparatus comprising:

a target electric-potential determination table for obtaining therefrom respective target values for said electrified portion electric-potential, exposed portion electric-potential, and developing biasing electric-potential, wherein said target values obtained may vary depending on variation in the relevant characteristics due to ambience and/or aging of said developing system; and control-input determination means for determining control-input for controlling said electrified portion electric-potential, exposed portion electric-potential and developing biasing electric-potential so as to respectively be said target values; and wherein said target electric-potential determination table is such that said target values may be obtained by reading values therein according to a saturated electrostatic-latent-image electric-potential on said photosensitive body at which potential amounts of toner adhered thereon varying due to the electrostatic-latent-image electric-potential starts being saturated, and according to the amount of toner adhered on said photosensitive body when the electrostatic-latent-image electric potential is said saturated electrostatic-latent-image electric-potential.

6. An electrophotographic-process control apparatus used in an electrophotographic process wherein an electrostatic latent image is generated on a photosensitive body through electrostatic-latent-image electric-potential comprising a difference between an electrified portion electric-potential and an exposed portion electric-potential, and said electrostatic latent image generated is then developed so as to generate a toner image by a developing system through a developer using developing biasing electric-potential, said electrophotographic-process control apparatus controlling said electrified portion electric-potential, exposed portion electric-potential, and developing biasing electric-potential so as to obtain a constant ratio between an input level in exposure to generate the electrostatic latent image and density associated with the toner-made image resulting from the developing of said electrostatic latent image, said electrophotographic-process control apparatus comprising:

a target electric-potential determination table for obtaining therefrom respective target values for said electrified portion electric-potential, exposed portion electric-potential, and developing biasing electric-potential, wherein said target values obtained may vary depending on variation in the relevant characteristics due to ambience and/or aging of said developing system; and control-input determination means for determining control-input for controlling said electrified portion electric-potential, exposed portion electric-potential and developing biasing electric-potential so as to respectively be said target values; and wherein said target electric-potential determination table is such that said target values may be obtained by reading the relevant portions therein according to a concentration of toner of said developer to be used for the developing.

7. An electrophotographic-process control apparatus used in an electrophotographic process wherein an electrostatic latent image is generated on a photosensitive body through electrostatic-latent-image electric-potential comprising a difference between an electrified portion electric-potential and an exposed portion electric-potential, and said electrostatic latent image generated is then developed so as to generate a toner image by a developing system through a developer using developing biasing electric-potential, said electrophotographic-process control apparatus controlling said electrified portion electric-potential, exposed portion electric-potential, and developing biasing electric-potential so as to obtain a constant ratio between an input level in exposure to generate the electrostatic latent image and density associated with the toner-made image resulting from the developing of said electrostatic latent image, said electrophotographic process control apparatus comprising:

a target electric-potential determination table for obtaining therefrom respective target values for said electrified portion electric-potential, exposed portion electric-potential, and developing biasing electric-potential, wherein said target values obtained may vary depending on the relevant characteristics due to ambience and/or aging of said developing system; and control-input determination means for determining control-input for controlling said electrified portion electric-potential, exposed portion electric-potential and developing biasing electric-potential so as to respectively be said target values; and wherein said target electric-potential determination table is such that said target values may be obtained by reading the relevant portions therein according to ambient humidity and according to an amount of the toner in the toner image resulting from developing in a predetermined condition.

8. An electrophotographic-process control apparatus used in an electrophotographic process wherein an electrostatic latent image is generated on a photosensitive body through electrostatic-latent-image electric-potential formed on said photosensitive body by controlling surface electric-potential thereon and said electrostatic latent image generated is then developed so as to generate a toner image by a developing system having developer, and said electrophotographic-process control apparatus comprising:

surface-electric-potential control means for controlling the surface electric-potential formed on said photosensitive body; and toner-concentration control means for controlling supplementation/removal of toner to/from said developing system so as to prevent toner concentration in said developing system from being either higher or lower than an appropriate toner concentration, wherein said toner-concentration means includes toner-concentration correction means for providing a signal for controlling the toner concentration when the electrostatic-latent-image electric-potential resulting from the control thereof leaves a predetermined threshold range, toner supplementing means for supplementing toner so as to make the toner concentration higher in response to a relevant signal being provided by said toner-concentration correction means, and toner removing means for partially removing toner so as to make the toner concentration lower in response to a relevant signal being provided by said toner-concentration correction means.

9. An electrophotographic-process control apparatus used in an electrophotographic process wherein an electrostatic latent image is generated on a photosensitive body through electrostatic-latent-image electric-potential formed on said photosensitive body by controlling surface electric-potential thereon and said electrostatic latent image generated is then developed so as to generate a toner image by a developing system having developer, and said electrophotographic-process control apparatus comprising:

surface-electric-potential control means for controlling the surface electric-potential formed on said photosensitive body; and toner-concentration control means for controlling supplementation/removal of toner to/from said developing system so as to prevent toner concentration in said developing system from being either higher or lower than an appropriate toner concentration;

wherein said toner-concentration control means comprises:

a toner-concentration correction means for providing a signal for controlling the toner concentration, when the electrostatic-latent-image electric-potential resulting from the control thereof leaves a predetermined threshold range;

a toner supplementation means for supplementing toner so as to make the toner concentration higher, in response to a relevant signal being provided by said toner-concentration correction means;

a toner removing means for partially removing toner so as to make the toner concentration lower, in response to a relevant signal being provided by said toner-concentration correction means; and wherein the signal to be provided by said toner-concentration correction means comprises a signal to be used to realize optimum control in carrying out toner supplementation/removal so as to control the toner concentration; and said toner-concentration correction means generates said signal using information concerning the toner concentration in the developing system detected before and after the time when the electrostatic-latent-image electric-potential leaves said predetermined threshold range.

10. An electrophotographic-process control apparatus used in an electrophotographic process wherein an electrostatic latent image is generated on a photosensitive body through electrostatic-latent-image electric-potential formed on said photosensitive body by controlling surface electric-potential thereon and said electrostatic latent image generated is then developed so as to generate a toner image by a developing system having developer, and said electrophotographic-process control apparatus comprising:

surface-electric-potential control means for controlling the surface electric-potential formed on said photosensitive body; and toner-concentration control means for controlling supplementation/removal of toner to/from said developing system so as to prevent toner concentration in said developing system from being either higher or lower than an appropriate toner concentration; and wherein said toner-concentration control means comprises:

a toner-concentration correction means for providing a signal, when the electrostatic-latent-image electric-potential resulting from the control thereof becomes outside of a predetermined threshold range, for controlling the toner concentration; and a toner-concentration changing means for controlling the toner concentration in response to a relevant signal being provided by said toner-concentration correction means;

and wherein:

the signal to be provided by said toner-concentration correction means comprises a signal to be used to realize optimum control in carrying out toner supplementation/removal so as to control the toner concentration; and said toner-concentration correction means generates said signal using information concerning the toner concentration in the developing system detected before and after the time when the electrostatic-latent-image electric-potential becomes outside said predetermined threshold range.

11. An electrophotographic-process control apparatus used in an electrophotographic process wherein an electrostatic latent image is generated on an photosensitive body through electrostatic-latent-image electric-potential comprising a difference between electrified portion electric-potential and exposed portion electric-potential, and said electrostatic latent image generated is then developed so as to generate a toner image by a developing system through developer using developing biasing electric-potential, said electrophotographic-process control apparatus controlling said electrified portion electric-potential, exposed portion electric-potential, and developing biasing electric-potential so as to obtain a constant ratio between an input level in exposure to generate the electrostatic latent image and the density associated with the toner-made image resulting from the developing for said electrostatic latent image, and said electrophotographic-process control apparatus comprising:

a target electric-potential determination means for determining at least one of respective target values for said electrified portion electric-potential, exposed portion electric-potential, and developing biasing electric-potential, wherein said target values to be determined may vary depending on variation in the relevant characteristics due to ambience and/or aging of said developing system, said target electric-potential determination means comprising a neural network, wherein information is used for the determination, which information to be used comprises information concerning any group of values among a first group comprising the toner concentration in said developing system and an amount of the toner used in the toner image resulting from developing in a predetermined condition, a second group comprising any two of a so-called toner-adhering-amount gamma value, saturated electrostatic-latent-image electric-potential, and a saturated toner amount, a third group comprising ambient humidity and toner concentration in said developing system and a fourth group comprising the ambient humidity and an amount of the toner used in the toner image resulting from developing in a predetermined condition, wherein said saturated electrostatic-latent-image electric-potential comprises electrostatic-latent-image electric potential on said photosensitive body at which potential amounts of toner adhered thereon, varying due to the electrostatic-latent-image electric-potential, starts being saturated, wherein said saturated toner amount comprises an amount of toner adhered on said photosensitive body due to electrostatic-latent-image electric-potential applied thereon when said saturated electrostatic-latent-image electric-potential is applied on said photosensitive body, and wherein said toner-adhering-amount gamma value comprises a relationship between the electrostatic-latent-image electric-potential generating the electrostatic latent image on said photosensitive body and an amount of the toner used in the toner image resulting from developing said electrostatic latent image; and control-input determination means for determining a control-input for controlling at least one of said electrified portion electric-potential, exposed portion electric-potential and developing biasing electric-potential so as to make it correspond to said target value determined by said target electric-potential determination means.

12. The electrophotographic-process control apparatus according to claim 11, wherein:

said target electric-potential determination means comprises either said neural network or a table configured properly for the determination; and said electrophotographic-process control apparatus further comprises a neural network for controlling the electrostatic-latent-image electric-potential using said control-input determined by said control-input determination means, wherein said neural network previously learns electrification/exposure characteristics of said photosensitive body for carrying out the control properly.

13. The electrophotographic-process control apparatus according to claim 11, wherein said target electric-potential determination means uses the residual electric potential of said photosensitive body for carrying out the relevant determination properly.

14. An electrophotographic-process control apparatus used in an electrophotographic process using a photosensitive body, comprising:

a target electric-potential determination table for obtaining therefrom a target value for an electric potential to be applied to said photosensitive body so as to produce a electrostatic latent image thereon, wherein said target value is determined by detecting actual characteristics as to how toner has adhered on said photosensitive body according to said electrostatic latent image; and control-input determination means for determining control-input for controlling said electric potential so that it is said target value.

15. An electrophotographic-process control apparatus used in an electrophotographic process using a photosensitive body and a developing system, comprising:

surface-electric-potential control means for controlling an electric potential formed on said photosensitive body so as to produce an electrostatic latent image thereon; and toner-concentration control means for controlling supplementation/removal of toner to/from said developing system so as to prevent toner concentration in said developing system from being either higher or lower than an appropriate toner concentration, said highness/lowness in the toner concentration being one which occurs at least in part due to a change of said electric potential.

* * * * *